United States Patent [19]

Durand

[11] 4,174,250

[45] Nov. 13, 1979

[54] APPARATUS FOR SUBLIMATION IMPRINTING TILES

[75] Inventor: David Durand, Bristol, R.I.

[73] Assignee: Freeman Transfer Printing Company, Inc., East Providence, R.I.

[21] Appl. No.: 895,229

[22] Filed: Apr. 10, 1978

[51] Int. Cl.[2] ..... B30B 15/34; B30B 5/02

[52] U.S. Cl. ..... 156/583.3; 8/2.5 A; 100/211; 101/470

[58] Field of Search ..... 100/211; 156/583; 101/470; 8/2.5 A; 68/5

[56] References Cited

U.S. PATENT DOCUMENTS

| | | | |
|---|---|---|---|
| 1,274,206 | 7/1918 | Shuman | 100/211 |
| 2,571,962 | 10/1951 | Smith | 156/238 |
| 2,647,337 | 8/1953 | Martin | 100/211 |
| 3,255,476 | 6/1966 | Dawson | 156/583 |
| 3,289,573 | 12/1966 | Apicella | 101/27 |
| 3,347,733 | 10/1967 | Elver | 156/583 |
| 3,418,926 | 12/1968 | Hakogi | 101/35 |
| 3,580,795 | 5/1971 | Eichenlaub | 156/583 |
| 3,620,881 | 11/1971 | Kannegiesser | 101/470 |
| 3,788,106 | 1/1974 | True | 101/470 |
| 4,055,456 | 10/1977 | Carnegie | 156/583 |

FOREIGN PATENT DOCUMENTS

| | | | |
|---|---|---|---|
| 1211149 | 11/1970 | United Kingdom | 8/2.5 R |

*Primary Examiner*—Clyde I. Coughenour
*Attorney, Agent, or Firm*—Salter & Michaelson

[57] ABSTRACT

An apparatus and method for imprinting articles such as tiles by the sublimation transfer of dyes into a dye receptive surface coating provided thereon. A platen having a press member formed of liquid metal and a flexible confining membrane is utilized to heat and press a sheet having the dye imprinted design thereon so as to sublimate such designs into the adjacent coated surface of the articles. The press member is accordingly both capable of transmitting heat and pressure to the surface coating of such articles so as to simultaneously transfer said design and the texture of the membrane, sheet or separate texturing member disposed therebetween to the surface of the article.

2 Claims, 3 Drawing Figures

APPARATUS FOR SUBLIMATION IMPRINTING TILES

BACKGROUND OF THE INVENTION

This invention relates to sublimation printing and particularly to a device and its novel manner of operation for transferring a sublimatible dye image or design imprinted on a transfer sheet to the surface of articles such as resin coated clay tiles, metal or paper sheet, wood and the like.

Printing through the use of sublimatible dyes is known and is rapidly becoming a more utilized process. Generally, the system involves the use of crystalline dye materials which will sublimate, that is, change from a solid to a gaseous phase without becoming liquid. These crystals are ground or pulverized to a fine particle size and then incorporated into a vehicle such as water so as to suspend and disperse the dye particles in such a manner so as to form an ink suitable for printing on a paper transfer sheet. The transfer sheet may be imprinted with such inks by any known commercial process to form the desired image or design in one or more colors. Thereafter, the transfer sheet is placed with its image side against an article having a dye receptive surface, such as a coating of resin plastic materials, i.e., polyester resin. The sheet and surface are then heated and a thermodynamic equilibrium is set up between the transfer sheet and the receptive surface which is to receive the imprinted design. The time required for effective equilibrium and thus effective transfer to occur is dependent upon known factors including the particular type of receptive coating, the dye concentration, the air gap between the sheet and surface, and the temperature of the various components. The dyes then sublimate into the surface where they condense to form the desired image on the article surface.

Many such sublimatible dyes are known as are the particular manners in which they may be utilized to form inks capable of being imprinted upon a transfer sheet and then later utilized to sublimate designs imprinted thereon to receptive surfaces. A decided advantage of this process over conventional printing is that far less sophisticated equipment is needed to effect transfer of the sublimatible design to the receptive surface once the transfer sheet has been printed by conventional processes. Accordingly, a transfer sheet may be imprinted using expensive printing processes at a central location and then the transfer sheets distributed to relatively lower technology areas having less expensive equipment to effect the sublimation transfer printing. This results in an effected use of high technology expensive printing equipment. The process further enables formation of wear resistant designs and for printing many materials which cannot be adequately printed by conventional techniques.

It would be further desirable to be able to utilize such sublimation printing techniques to print the surface of decorative materials such as tiles and the like and to simultaneously provide such tiles with a decorative, three-dimensional embossed surface. Accordingly, a main object of the present invention is to provide a device which may be utilized to provide a decorative design on the surface of articles such as clay tiles and the like through the use of sublimation printing techniques.

A further object of the present invention is the provisions of a novel platen structure through which the necessary heat to effect such sublimation printing is transferred from the platen to both the transfer sheet and the surface of the tile or other article to be imprinted.

A still further object of the present invention is the provision of a novel platen construction utilizing a heat conductive press member which enables the surface of an article to be embossed while simultaneously receiving a sublimated image thereon.

These and other objects of the present invention are accomplished by the provision of a platen having a press member comprising liquid heat-conductive metal disposed within a recess in such platen and a flexible member spanning such recess so as to restrain the movement of such liquid metal. In this manner then, as heat is applied to the platen, it is conducted to both the transfer sheet and the article surface so as to enable sublimation of the dyes to take place and the movement and subsequent condensation of such dyes in the receptive surface.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
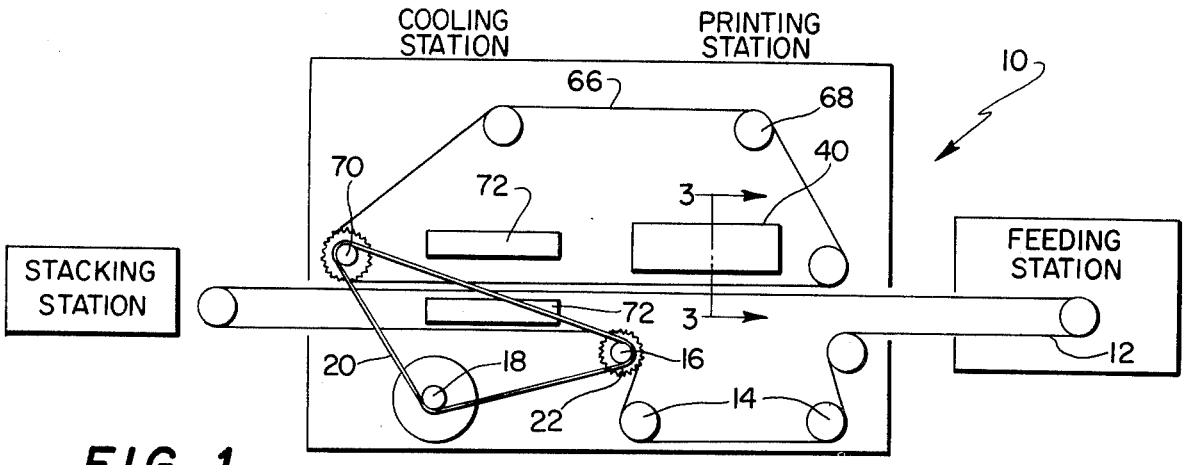
FIG. 1 is an overall schematic view of a printing line incorporating the present invention.
Figure 2:
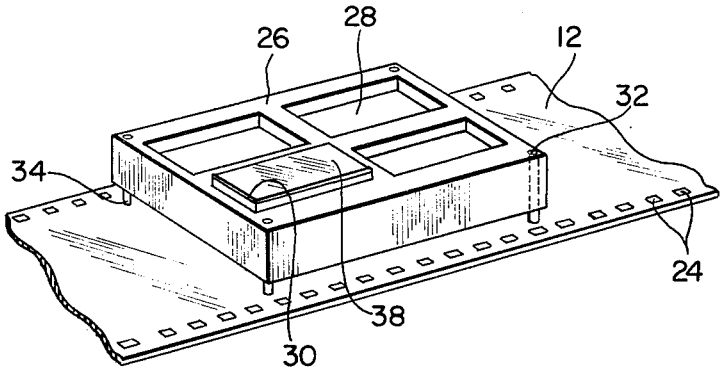
FIG. 2 is a partial perpsective view of a belt including a nest for articles to be transfer imprinted positioned thereon.

Turning now to the drawings and particularly FIG. 1 thereof, a machine or printing plant 10 is shown wherein articles such as coated tile and the like may be sublimation printed using the novel method and apparatus of the present invention. Such machine 10 includes four work stations including a feeding or loading station, a printing station, a cooling station and a take-away or stacking station. These work stations are connected to each other by a conveyor belt 12 suitably trained about a plurality of idler rollers 14 and propelled by a drive roller 16 which is in turn connected to a source of power, such as the motor 18, by a drive belt 20. The conveyor belt 12 is driven in timed sequence with the rotation of the drive pulley 16 such as by the engagement of drive roller spocket teeth 22 into a plurality of separate openings 24 provided in one or both side edges of the conveyor belt 12. In this manner then, the conveyor belt 12 is driven in a positive timed relationship to the various operations of the machine, as will hereinafter be apparent.

The upper surface of the belt 12 is adapted to support an article carrier 26 having a plurality of pockets 28 for receiving articles 30 which are to be sublimation printed. The corners of the generally rectangular shaped carrier 26 are provided with openings 32 into or through which projections 34 upwardly extending from the surface of the belt 24 are adapted to project. In this manner the article carrier and accordingly the articles 30 are disposed in a fixed relation relative to the belt 12. Generally, a plurality of such article carriers 26 is utilized such that the functions of the various work stations of the machine 10 may be carried on simultaneously, that is, loading, printing, cooling and stacking of different tiles in various stages of completion may be carried on at once in a continuous manner through the machine 10. Alternatively, the machine could operate cyclically such that a full feed, print, cool and stack cycle was completed prior to initiating further processing in which case the belt 12 could be adapted for reverse directional movement.

The articles 30 may be common clay tiles in which a sublimatible dye receptive coating is formed on the upper surface thereof. Suitable materials for the formation of such coating include epoxy and polyester plastic resin compositions or combinations thereof. The resin coating may be electrostatically applied in powder form and then the tile and the coating baked at a suitable temperature so as to form a smooth continuous coating 38 on the outside surface of the tile. Alternatively and particularly appropriate with flat tile surfaces, the dye receptive polymeric material may be roll coated on the outer surface of the tile and then cured with ultraviolet light. The above-indicated coating methods result in different hardness coatings, i.e., the powder coating method resulting in a harder coating. Accordingly, the use to which the final article will be subjected, as well as its shape and other physical characteristics, will determine the particular type coating method to be utilized. It has been found that general purpose polyester plastic resin coated and cured in either of the above indicated manners is suitable for the formation of the specific articles hereunder consideration—namely, common porous clay tiles having a sublimatible dye receptive resin coating.

Figure 3:
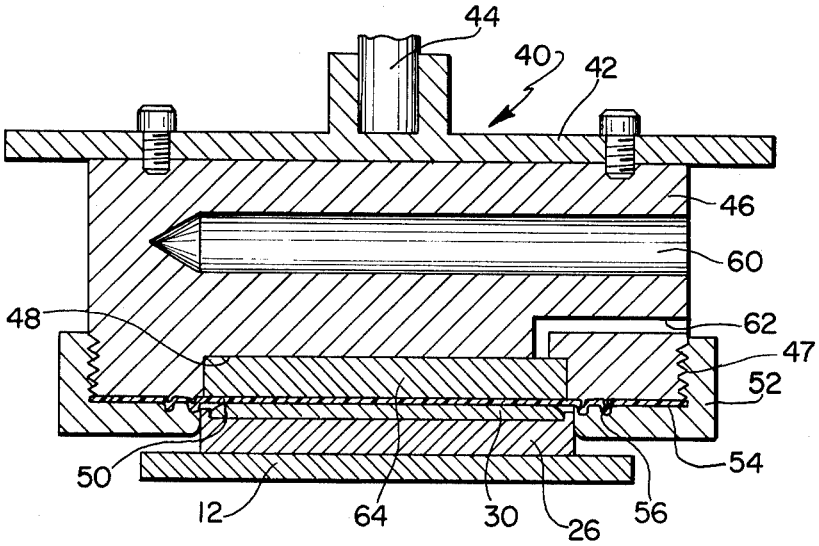
FIG. 3 is an enlarged sectional veiw of the platen construction of the present invention taken along the line of 3–3 of FIG. 1.

As best shown in FIG. 3, a platen 40 including a frame 42 is suitable positioned in the printing station for vertical movement with respect to the belt 12 moving therebeneath, as by a hydraulically operated piston 44. The frame suitably supports a metal platen body 46 constructed of aluminum or other lightweight heat-conductive material. The lower face of the platen body 46 includes a recess 48 having an open face in turn sealed by an enclosing membrane 50 formed from a suitable highly flexible material such as silicone rubber compound in sheet form. The membrane 50 is suitably clamped across the open face of the recess 48 by means of a collar 52 suitably secured to the body 46 such as by a threaded connection 47 when the body 46 is cylindrical in shape, or by other suitable securement means when of other configurations. In this manner, means are provided by which the edges of the membrane 50 may be secured to the body 46, i.e., the outer extremities 54 of the membrane are clamped between the bottom surface of the body 46 and collar 52. Additionally, the bottom surface of the body 46 and the collar 52 are provided with one or more circumferentially spaced complementary ridges 56 which cause the membrane to undulate thus assuring a more positive lock on the edges of the membrane 50 and further assuring that the membrane provides a liquid-tight seal for recess 48.

The body of the platen is provided with a bore 60 for receiving an electrical heater (not shown). Additionally, a bore 62 communicates with the recess 48 so that a supply of liquid metal, such as lead-based solder material 64, heated to a suitable temperature so as to assure a liquid condition, may be introduced to said recess. The metal 64 is disposed within the recess 48 under pressure from any suitable source, such as a pump or piston (not shown). The membrane 50 serves to restrain the liquid metal 64 within the recess 48 and thus forms a press assembly which is both heat conductive and capable of transmitting pressure to the tile surface being imprinted.

The machine 10 is additionally provided with a pair of laterally spaced belts 66 trained over idler rollers 68 and driven by a drive roll 70. The drive roller is in turn driven by drive belt 20. As the belts 66 move through the printing station, they are adapted to contact opposite edge portions of the belt 12. An imprinted transfer sheet (not shown) is disposed, as by hand upon the article carrier 26 in proper registration with the article 30 (or articles 30, assuming that more than one of the pockets 28 are loaded) such that its edges are also disposed over the above desscribed edge portions of belt 12, so that as the belts 66 and 12 move into contact with each other they will simultaneously engage the edges of the transfer sheet between them so as to hold the sheet in proper registration at the printing station. The printing step then is carried out while the belts are stationary, after which further movement of the belts causes the removal of the transfer sheet from the printing station. The belt 12 sequentially moves the articles imprinted in the printing station to the cooling station and then onto the stacking station. During the above indicated sequence of events, the belt 12 is moved in timed relation for disposition underneath the press assembly whereupon when the belt stops, the platen is thereafter activated so as to cause the membrane 50 of the press assembly to firmly force the transfer sheet into close contact with the surface of tiles 30, that is, into engagement with the sublimatible dye-receptive coating 38 formed thereon. The platen is then heated to a temperature high enough to raise the level of the transfer sheet above a predetermined temperature at which effective sublimation of the dyes takes place and to simultaneously raise the temperature level of the article coating 38 to a point at which it becomes readily receptive to penetration and subsequent condensation of the dyes thereinto. In this way, the sublimation printing of the design formed on the transfer sheet is transferred to the coating 38 and becomes a permanent part thereof. Additionally, use of the liquid metal 64 as part of the press assembly not only enables the heat to be quickly transferred to the transfer paper, but additionally enables the pressure from the platen 40 to be transmitted thereto. The membrane 50 also acts as a smoothing member such that a smooth glass-like finish may be transmitted to the surface of the plastic coating 38.

The transfer paper is preferably a non-porous paper designated as French paper and is preferably coated, after being ink imprinted with the appropriate image design, with a thin layer of polyethylene on the order of one mil or less. When the transfer sheet and the surface of the article to be printed contact each other, the polyethylene layer will serve as a release agent assuring that the transfer paper will not stick to the softened resin coating 38. Additionally, the polyethylene layer also allows the transmission of the sublimed dyes without significant absorption or distortion thereof such that the dyes upon heating to sublimation temperatures move from the transfer paper, pass through the polyethylene layer and thereafter condense in the plastic resin coating 38. The design thus formed by this sublimation transfer process penetrates to some degree into the coating 38 and will thus not rub or wear off with normal use. When general purpose polyester resin is utilized as the coating 38, sublimation temperature ranges in the order of 370° to 410° have been found satisfactory.

At this temperature range, it should be pointed out that such resins are somewhat deformable and accordingly, a further important feature of the present invention includes the insertion of texturing or embossing grids (not shown) between the transfer paper and the surface of the articles 30 such that when the platen forces the transfer sheet, grid and article surface into intimate contact with each other, surface textures or contours appropriate to enhance the particular color designs being transferred may be additionally imparted thereto. Such grids may take the form of open metal or paper members. In this connection it will be understood that the inherent flexibility of the liquid platen enables the latter, i.e., the membrane 50, to distort sufficiently so that effective pressure is applied by the platen not only to the grid, but also to those areas of the article 30 not covered by the grid. Expressed differently, if the platen, i.e., membrane 50 were rigid and inflexible, and a grid member interposed between the platen and the article 30, the platen would not be able to make pressurized engagement with the portions of article 30 not covered by the grid since the latter would maintain the platen and the article in spaced relation. As stated, this problem is overcome by utilizing the aforesaid liquid metal platen.

After imprinting, the belt 12 is then indexed to the cooling station whereupon a pair of cooling platens 72 are activated so as to be disposed on opposite sides of the article carrier 26 and the belt 12 in such a manner so as to cool the carrier 26 as well as the articles 30 for subsequent stacking.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for transferring a design imprinted on a transfer sheet in dyes which are sublimatible at a predetermined temperature to an article having a plastic resin upper surface capable of receiving said dyes, comprising a platen having a heat conductive press member, means for receiving and moving said article so as to place said upper surface and said press member in opposed position to each other, means for disposing the transfer sheet between said article and said press member, means for moving said press member toward said article so as to force said sheet into direct contact with said article upper suface, and means for heating the platen so as to raise the temperature of said sheet and said article surface to said predetermined temperature so as to sublimate said design into said surface, said press member including a mass of heat conductive liquid metal restrained within a recess in said platen, and a flexible membrane spanning said recess, said membrane adapted to contact said sheet, said platen forming a part of a heat activated printing station, a cooling station positioned adjacent said printing station for cooling said article after being heated in said printing station, said means for receiving and moving said article being a flexible endless belt movable between said printing and cooling station, said belt including an article carrier mounted thereon, said carrier having nest means for supporting a plurality of said articles and means for indexing said carrier into registry with said platen, said belt being wider than said carrier whereby edge portions of said belt are uncovered adjacent said carrier, said transfer sheet being dimensioned so as to cover said carrier and said edge portions, and a pair of second belts engaging the edge portions of said first belt so as to maintain said transfer sheet clamped between said first and second belts and hence in proper registry with said carrier.

2. A method of sublimation printing a design onto the surface of an article having a dye receptive plastic resin surface, comprising providing a sheet having a design imprinted thereon with sublimatible dyes, placing said sheet between said surface of said article and the press member of a heat and pressure transmitting platen, placing a texturing screen between said press member and said article coating, heating said platen to a predetermined temperature at which said dyes will sublimate and then moving said platen to force said sheet against said surface so as to cause said dyes to sublimate and penetrate said surface, thereby transferring said design to said article, the heat transmitted by said platen causing sufficient softening of said plastic resin surface so as to cause texturing thereof pursuant to the pressurized engagement of said screen thereagainst.

* * * * *